US005466982A

United States Patent [19]

Akinwande

[11] Patent Number: 5,466,982

[45] Date of Patent: Nov. 14, 1995

[54] COMB TOOTHED FIELD EMITTER STRUCTURE HAVING RESISTIVE AND CAPACITIVE COUPLED INPUT

[75] Inventor: Akintunde I. Akinwande, Bloomington, Minn.

[73] Assignee: Honeywell Inc., Minneapolis, Minn.

[21] Appl. No.: 101,123

[22] Filed: Oct. 18, 1993

[51] Int. Cl.[6] ..... H01J 1/30

[52] U.S. Cl. ..... 313/309; 313/310; 313/336; 313/355

[58] Field of Search ..... 313/310, 308, 313/309, 332, 351, 13, 43, 336; 315/169.4; 345/37, 40, 60

[56] References Cited

U.S. PATENT DOCUMENTS

| | | | |
|---|---|---|---|
| 3,665,241 | 5/1972 | Spindt et al. | 313/336 X |
| 4,096,406 | 6/1978 | Miran et al. | 313/348 X |
| 4,788,584 | 11/1988 | Hirano et al. | 257/728 |
| 4,901,028 | 2/1990 | Gray et al. | 330/54 |
| 4,987,377 | 1/1991 | Gray et al. | 313/309 X |
| 5,142,184 | 8/1992 | Kane | 313/336 X |
| 5,170,092 | 12/1992 | Tomii et al. | 313/310 |
| 5,214,347 | 5/1993 | Gray | 313/310 X |

OTHER PUBLICATIONS

Ivor Brodie, "Bombardment of field–emission cathodes by positive ions formed in the interelectrode region" *Int. J. Electronics,* vol. 38, No. 4 (1975), pp. 541–550.

J. Browning et al., "Experimental Observations of Gated Field Emitter Failure" *IEEE Electron Device Letters,* vol. 13, No. 3, Mar. 1992.

*Primary Examiner*—Sandra L. O'Shea
*Assistant Examiner*—Vip Patel
*Attorney, Agent, or Firm*—John G. Shudy, Jr.

[57] ABSTRACT

A field emitter structure with emitter edge comprising of individual comb elements. A resistive film is inserted between the lead-in conductor and the emitter edge and a conductive film is electrically attached to the conductor and capacitively coupled to the emitter.

17 Claims, 6 Drawing Sheets

40
2c
2b
61
63
2a
44
53
43
51
50
41
52
42
54

2
e $e_n$
2
$e_1$ $e_n$
$e_1$
2

$e_n$
$e_1$
2

COMB TOOTHED FIELD EMITTER STRUCTURE HAVING RESISTIVE AND CAPACITIVE COUPLED INPUT

BACKGROUND OF THE INVENTION

1. Field of the Invention

This invention relates to thin film emitter structures in field emission devices and more specifically thin film emitter structures in vacuum microelectronic three terminal devices.

22. Description of Related Art

Vacuum microelectronic three terminal devices, typically described as vacuum transistors or vacuum triodes, use a technology associated with electron transport in vacuum and are fabricated with modern microfabrication technology developed for solid state devices. Microelectronic triodes are built using thin film techniques and operate similarly to vacuum tube triodes while utilizing integrated circuit and micromachining techniques for fabrication. As a result, microelectronic triodes have a number of significant advantages over their predecessors. These include having a wider operable temperature range, higher efficiency performance, smaller and lighter weight packaging, higher resistance to radiation damage and a lower manufacturing cost.

Three terminal devices, such as the microelectronic triode, generally include three elements: a single cathode, a control electrode and an anode, although there may be variations having pluralities of any of these parts. The control electrodes act as a gate which controls the current flow between the anode and the electron-emitting cathode. Such devices are used in microwave and millimeter frequency applications requiring large power, such as in the utilization of active antenna arrays in electronic countermeasures, radar and communication systems.

Field emission devices have the problem of being unreliable. The electron-emitting cathodes, or emitters, often experience a problem with d.c. burn-out at their emitting edges. Burn-out is a phenomenon which occurs when excessive current is run through the emitter. Studies on the failure of field emitters are documented in papers by Ivor Brodie, "Bombardment of Field-emission Cathodes by Positive Ions Formed in the Interelectrode Region", Int. J. Electronics, Vol. 38, No. 4, 1975 and Jim Browning, Nicol E. McGruer, W. J. Bintz, and M. Gilmore, "Experimental Observations of Gated Field Emitter Failures", IEEE Electron Device Letters, Vol. 13, No. 13, Mar. 1992. Burn-out initiates at a small point on the emitter and eventually spreads and burns out the entire emitter, making the entire device inoperable.

Excessive current leading to burn-out at the emitter edge normally occur in two instances. The first instance is when there are several "whiskers" or sharp points on the surface of the emitter structure. Sharp points are points on the emitter where there is a concentrated electric field which attracts current. When there are too many sharp points on the emitter burn-out occurs.

The second instance when burn-out occurs is when energy in stray capacitances discharge uncontrollably at the emitter. The discharge rate of capacitance generally depends on the value of the resistance in series with it. When a large charge build-up is discharged over a small resistance in a microelectronic triode, there is a danger that the high current will cause burn-out.

In the past, large resistors were placed in series between the lead-in conductor and the emitter to solve the emitter edge burnout problem. As a result, d.c. current to the emitter would be limited for any given applied voltage by the resistance. This arrangement achieved the purpose of limiting the emission current. It would also, however, produce the undesirable result of degrading the performance of the emitter by lowering its transconduction constant.

SUMMARY OF THE INVENTION

The present invention generally teaches a microstructure in thin films to prevent d.c. burnout of emitting edges by excessive current while allowing for a high constant of transconductance.

This invention also teaches a microstructure in thin films which allows amplification of high frequency microwave signals as if the current limiting load line were due to a very small resistor, thus greatly increasing the gain of the amplifier.

To accomplish these goals, a large value resistive element is placed in series between the lead-in conductor and the emitter in this invention to limit the d.c. current. In order to enable applications of high frequency microwave signals, a capacitor in parallel with the resistor is used to provide a high frequency bypass for a.c. current through the lead-in conductor. As a result, the d.c. current will still be limited for any given applied voltage by the resistive element, but high frequency microwave currents will bypass the resistance through the capacitive structure formed by the resistive element, conductive element and dielectric film. The emitter or emitter edges are segmented into a plurality of long strips resembling comb teeth. The segmentation of the emitter edge isolates any burn-out problem that may occur to one tooth-like structure at a time. By localizing the edge length, the likelihood of the spread of the burn-out is eliminated. Thus, the remainder of the emitter (the other tooth-like structures) will be free from spreading burn-out danger. Accordingly the useful life of such emitters is enhanced by incorporating the teachings of this invention. In applications where numerous emitters will be used, the useful life of such devices will be greatly enhanced by using these teachings.

Additional objects, advantages, and characteristic features of the present invention will become readily apparent from the following description of preferred embodiments of the invention when considered in conjunction with the accompanying drawings.

DESCRIPTION OF THE PREFERRED EMBODIMENTS

Figure 1:
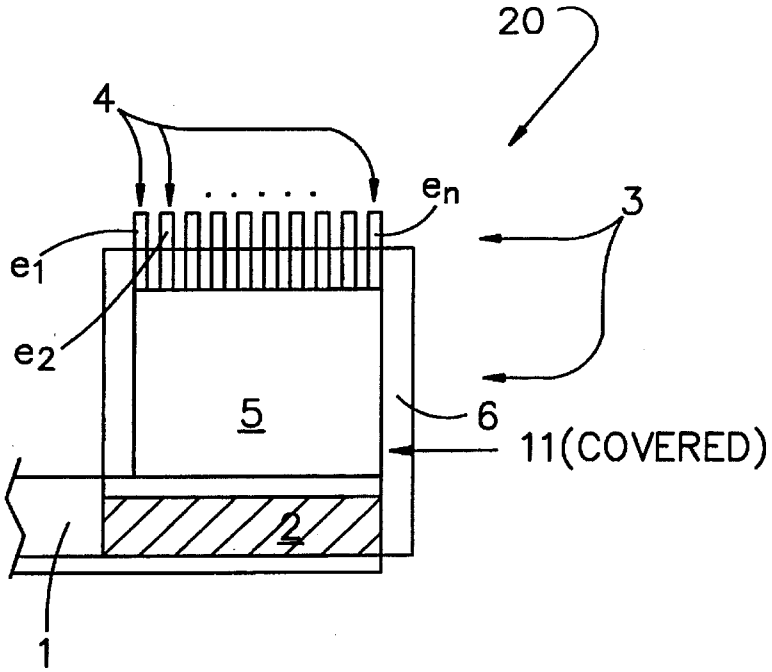
FIG. 1 is a plan view of a vacuum transistor illustrating one embodiment of the invention.

With reference to FIG. 1, there is shown a plan view of one embodiment 20 of the present invention. A lead-in conductor 1, is in electrical connection with an outside voltage source, and is in contact with an emitter structure 3, through a resistive element 5, and a conductive element 6 at electrical contact 2. The lead-in conductor 1 preferably physically contacts only the resistive element 5.

The emitter edge 4 of the emitter structure 3 is $e_1 \ldots e_n$. The segmentation of the emitter edge serves segmented into a plurality of comb-like elements 10 to isolate burn-out problems. Localizing the edge length will prevent spreading of the burn-out and confine the problem to its originating comb element.

A resistive film 5, typically but not limited to tantalum nitride or a polysilicon, is formed through thin film construction techniques to be in contact with the emitter structure 3 so that the resistance applied is in series with the emitter edge 4. The resistive film serves to limit excessive d.c. emission currents to the emitter edge from sharp points or uncontrollable discharges from stray capacitances.

A conductive film 6 and an insulator 11, in the preferred embodiment which is an oxide or nitride, is also through thin film techniques layered above resistive film 5 such that the elements are in parallel with each other. Together, the resistive film 5, insulator 11, and conductive film 6 serve as a capacitor which provides a high frequency bypass for a.c. current through the lead-in conductor 1. The capacitor enables amplification of high frequency microwave signals as if the current limiting load line were due to a very small resistor, thus greatly increasing the gain of the amplifier. It is believed that this because the d.c. current is limited in its ability to damage the emitter by the resistor; and because the bypass capacitor provides another way for the high frequency signal to pass the emitter.

Figure 2:
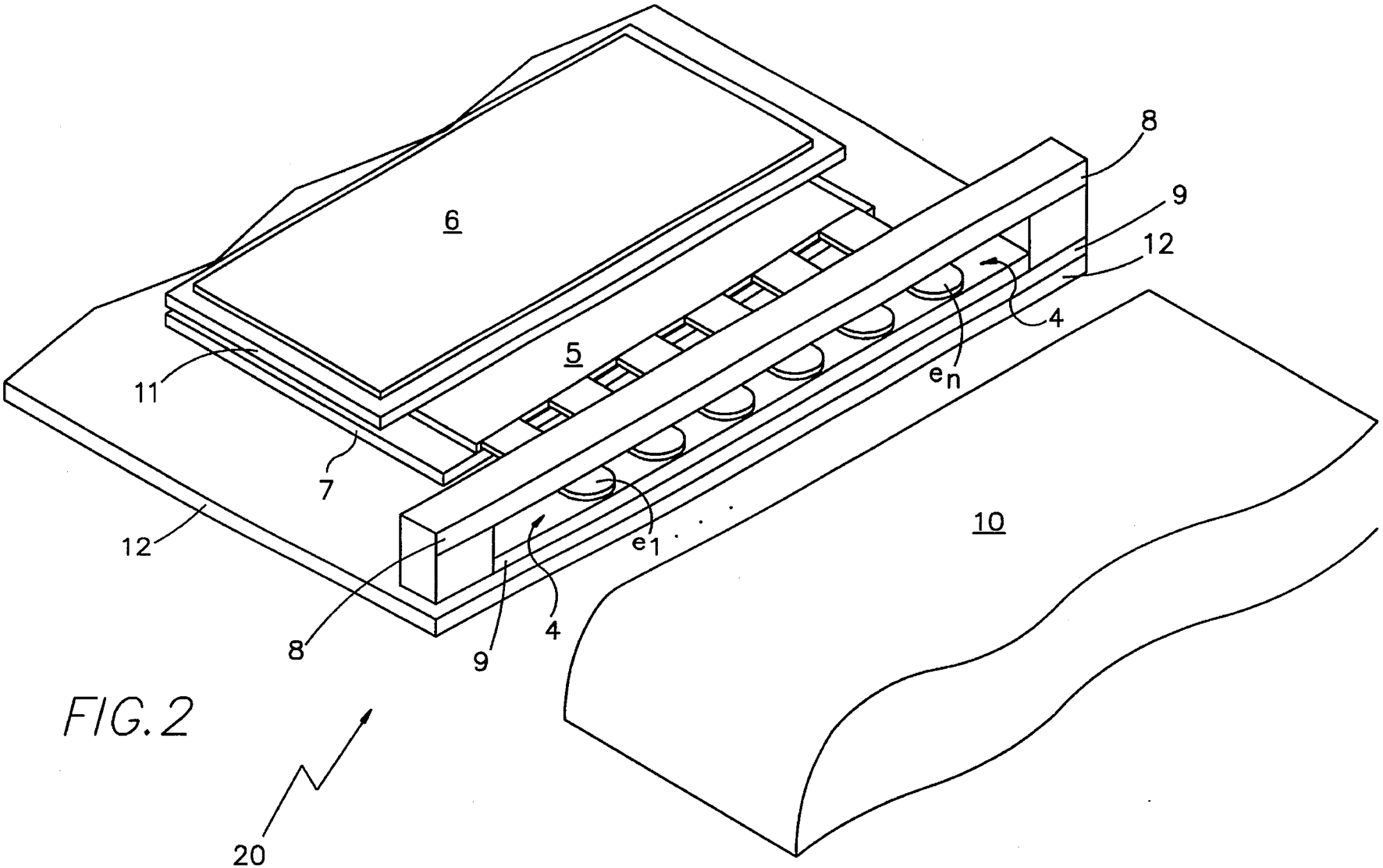
FIG. 2 is a three dimensional conceptual view of the device of FIG. 1.

FIG. 2 shows a conceptual view of the embodiment illustrated in FIG. 1. The structure shown at 7 serves as a support layer. Also visible in this view is the insulating substrate layer 12, and the upper and lower control electrodes 8 and 9 in this embodiment. The control electrode acts as a lateral gate which controls the current flow between the anode 10 and the electron-emitting cathode 4.

Figure 3:
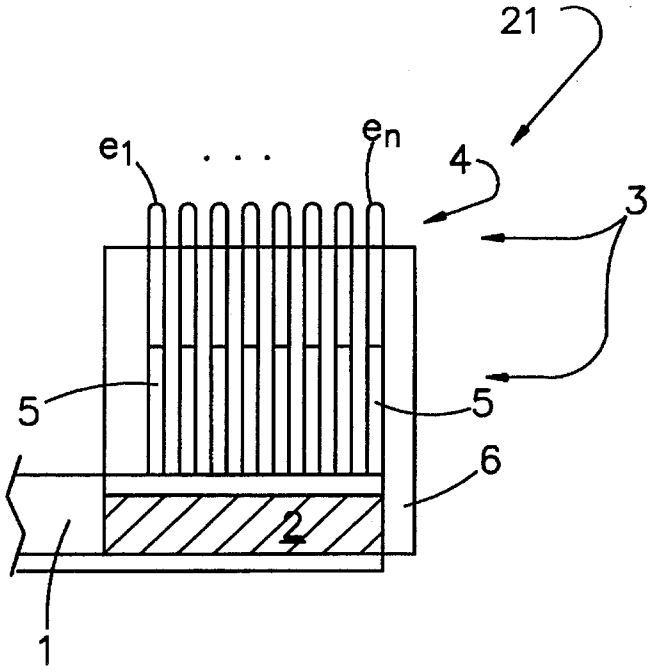
FIG. 3 is a plan view of a vacuum transistor illustrating another embodiment of the invention.
Figure 4:
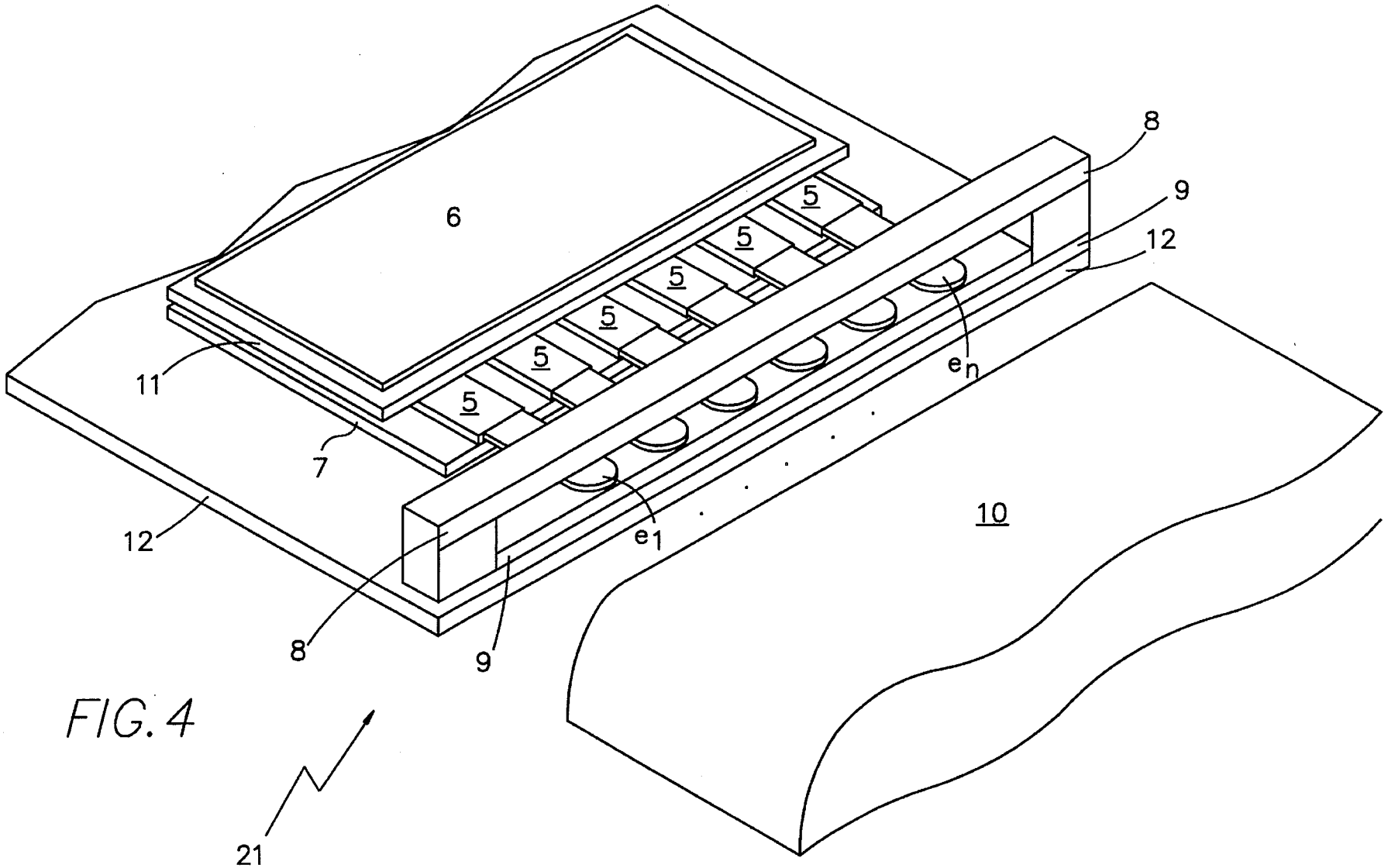
FIG. 4 is a three dimensional conceptual view of the device illustrated in FIG. 3.

FIG. 3 and FIG. 4 show plan and conceptual views, respectively, of a preferred second embodiment of this invention. In this second embodiment, the entire emitter structure is segmented into comb-like elements 4. Each comb-like element $e_1 \ldots e_n$ has an individual resistor element 5 connecting it to the conductor contact 2.

The arrangement of the second embodiment enables a larger total current to be drawn without burning out the individual comb elements. The first embodiment, shown in FIG. 1 and FIG. 2, enables a lesser amount of total current to be drawn than the second embodiment (assuming the two were of the same size), but has a more effective capacitive coupling because of the larger area of the resistive film.

Figure 5:
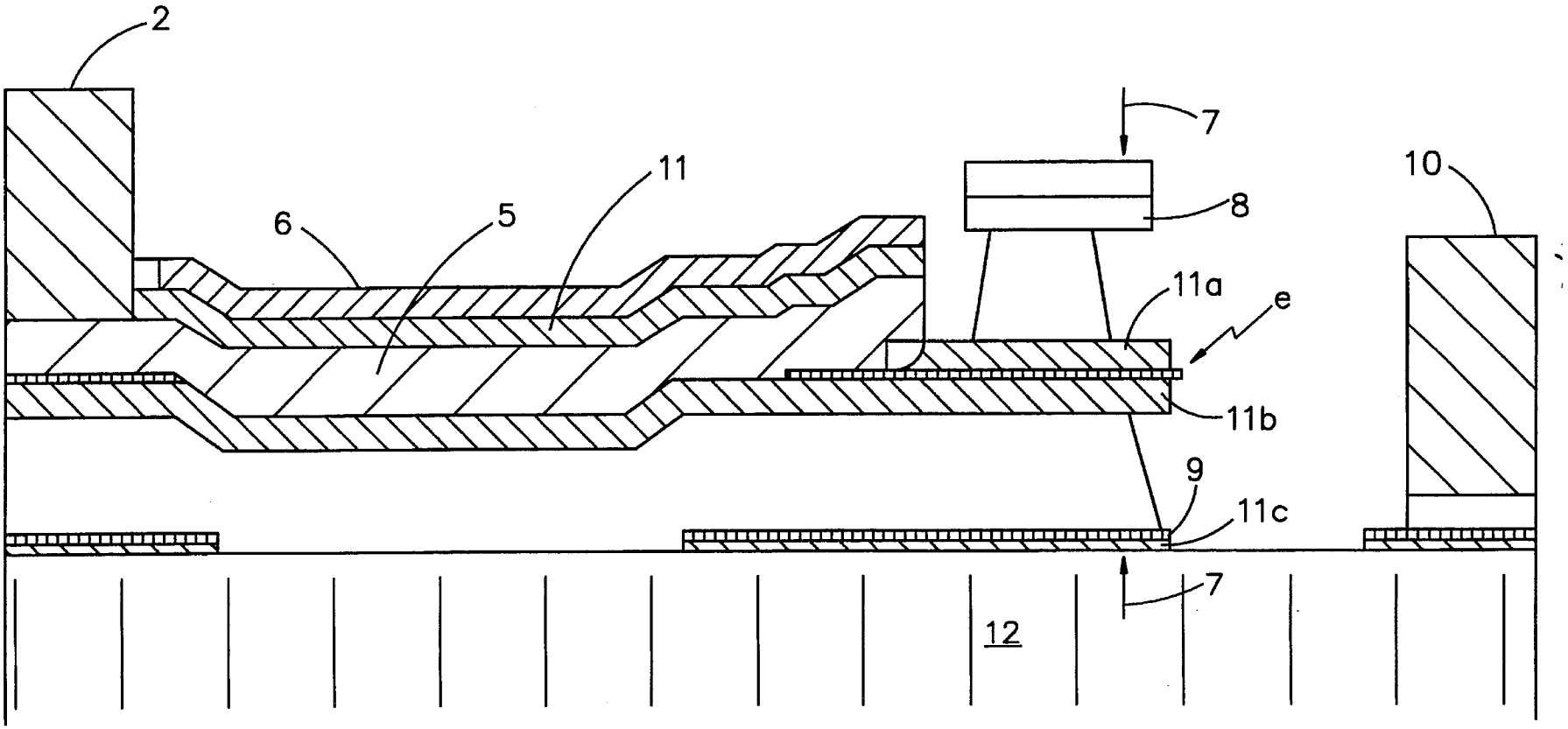
FIG. 5 is a side view of a vacuum transistor which could illustrate either one of the two preferred embodiments of this invention.

FIG. 5 shows a side view which could represent either one of the two embodiments of this invention. Also shown in FIG. 5 is the dielectric material 11, between the conductive element 6 and the resistive element 5, as well as the insulating substrate 12 upon which the embodiment is constructed Layers 11*a* and 11*b* provide support for emmitter e. Layer 11*c* provides support for lower electrode 9.

Figure 6A:
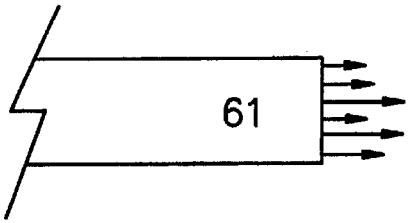
FIGS. 6*a* and 6*b* are detail plan view illustrations of a comb tooth emitter edge constructed in accord with this invention.
Figure 6B:
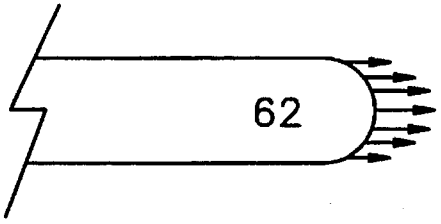

FIGS. 6a and 6b illustrate two emitter edges 61 and 62, with arrows suggesting electron flow at the edge of each. The ridged edge type of FIG. 6*b* is presently preferred because the corners of 61 are likely to cause concentration of electron emission and begin failure.

Figure 7:
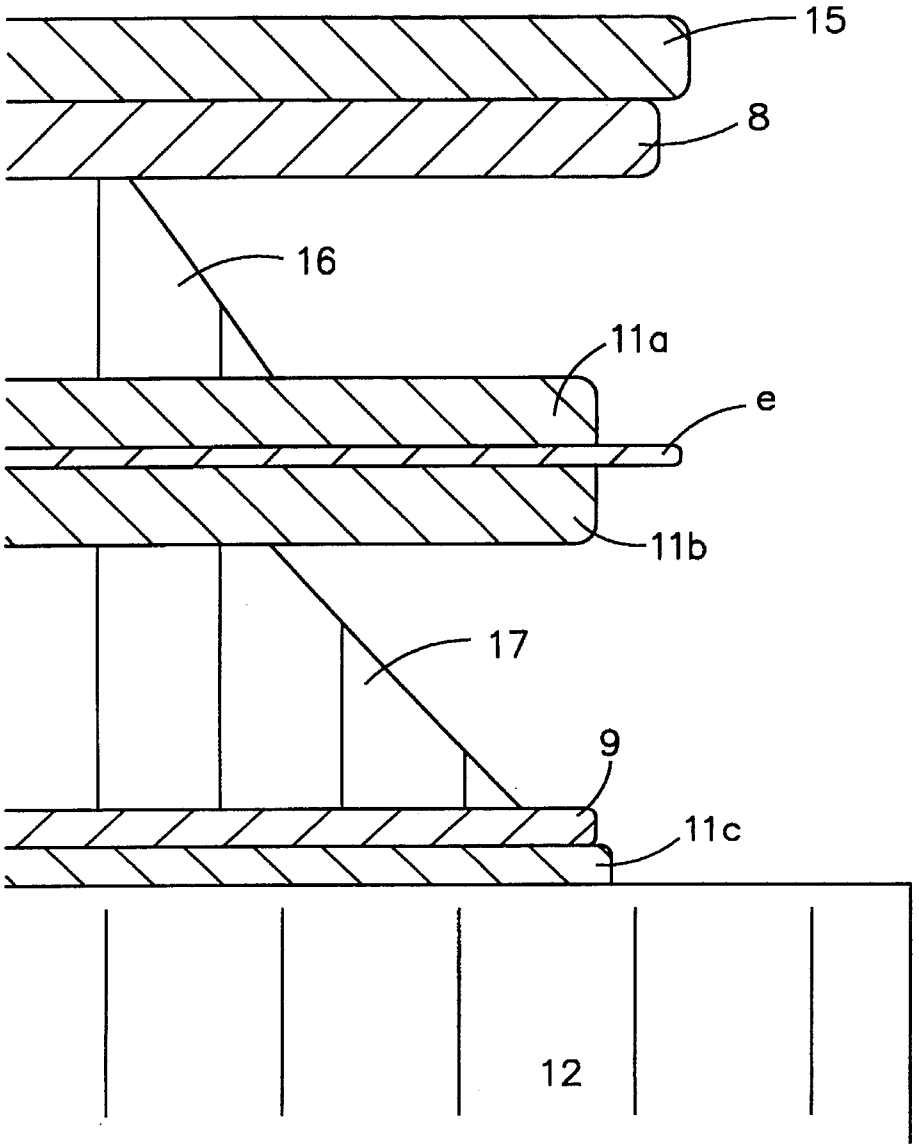
FIG. 7 is a detailed side view taken at line 7—7 of FIG. 5.

FIG. 7 is a detailed side view taken at line 7—7 of FIG. 5. From the top, there is, in the preferred embodiment, a support layer 15 (preferably nitride, though other well known support layers with similar electrical characteristics could be used). The upper control electrode 8 (preferably TiW, around 2500Å, though other metals or conductive materials could be used), an upper sacrificed layer 16 (in the preferred embodiment $SiO_2$; about 3000Å, although other supporting materials of similar electrical qualities could be substituted); the emitter surrounded by two support layers (in the preferred embodiment the support layers are nitride 11*a* and 11*b* of about 2000Å thickness and the emitter e, a 300Å layer of TiW, although substitute materials may be used as in the similar above layers). Below this, is another "lower" sacrifice layer 17, similar in makeup and thickness to the upper sacrifice layer 16 and the lower electrode 9, about 1000Å of TiW in the preferred embodiment. The whole structure is supported by another support layer 11*c* (of about 1000Å in the preferred embodiment) and laid down upon $SiO_2$ wafer 12 (again, here too, substitutes such as crystalline silicon could be substituted for instance. Most reasonable substitute materials will occur easily to one of ordering skill in these arts.).

Figures 8A, 8B, 8C, 8D, 9:
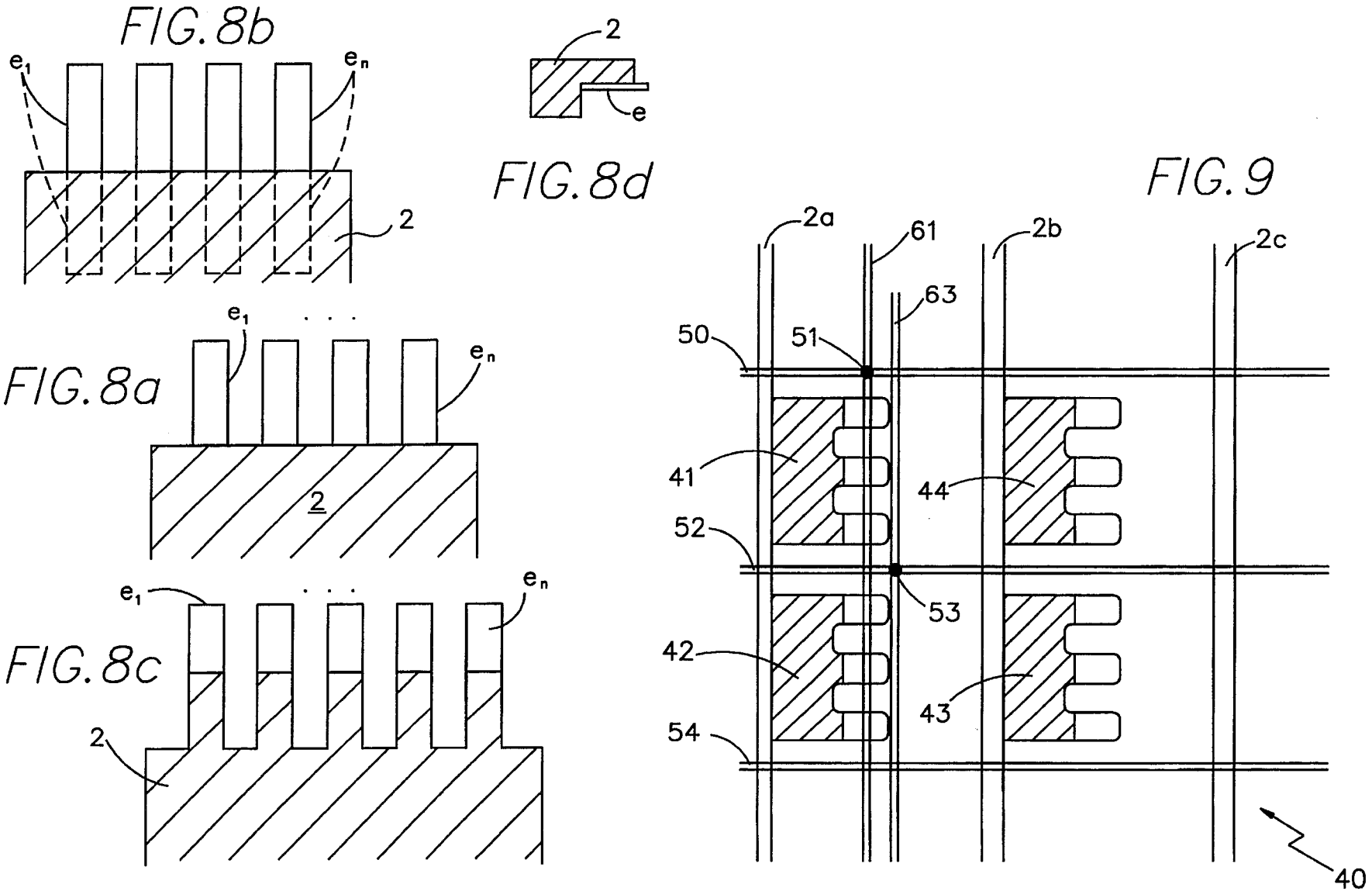
FIGS. 8*a, b, c* and *d* are views of emitter-resistor structures in accord with this invention.
FIG. 9 is an array of emmiters of the type taught by this invention.

FIGS. 8*a*, 8*b*, 8*c* illustrate three alternatives for comb structure 4 combined with resister elements 2.

FIG. 8*d* is a side cross-section view of element e of the embodiment shown in FIG. 8*b*.

FIG. 9 shows a piece 40 of an array employing emitters 41, 42, 43, and 44 and resistor elements 2*a*, 2*b* and 2*c*, as taught in this invention. Control electrode wires 50, 52, and 54 (metalization or other current carrying structures) and lines 61 and 63 are connected at junctions 51 and 53, respectively, to turn on emitter 41.

We claim:

1. A field emitter structure comprising:

a flat emitter structure, having an outer emitter edge constructed of thin film layered material;

a resistive element constructed of thin film layered material formed next to and connected in series with the flat emitter structure;

a lead-in conductor partially formed on and connected to the resistive element; and a conductive element constructed of thin film layered material formed on a dielectric layered material which is in turn formed on the resistive element to form a capacitor element, so arranged and disposed such that said conductive element is capacitively coupled to the emitter edge; and wherein the outer emitter edge, opposite that of the lead-in conductor, is segmented into a plurality of long strips resembling comb elements.

2. The field emitter structure in claim 1, wherein the entire flat emitter structure is segmented into a plurality of long strips resembling comb elements.

3. The field emitter structure in claim 2, wherein the resistive element is a film between said lead-in conductor and the outer emitter edge and in electrical contact with the emitter so as to be in series with the emitter.

4. The field emitter structure in claim 2, wherein the resistive element is a film between said lead-in conductor and the outer emitter edge and in electrical contact with each of the emitter comb elements so as to be in series with the emitter comb elements.

5. The field emitter structure in claim 2, wherein the resistive element is constructed in thin film and formed so as to be segmented into several comb elements between said lead-in conductor and the outer emitter edge and in electrical contact with each of the emitter comb elements so as to be in series with the emitter comb elements.

6. The field emitter structure as set forth in claim 1, further comprising at least one control electrode that is in proximity to the emitter edge and spaced apart therefrom.

7. The field emitter structure as set forth in claim 6, comprising an array of flat emitter structures, each flat emitter structure of said array being like that of said flat emitter structure.

8. A field emitter structure comprising: a flat emitter structure having an emitter edge; a resistive element formed next to and connected in series with the flat emitter structure; a lead-in conductor formed partially on and in contact with the resistive element; and a conductive element with dielectric material layered and formed on the resistive element to form a capacitor element, for coupling the conductive element capacitively to the emitter edge; and wherein the emitter edge, opposite that of the lead-in conductor, is segmented into a plurality of long strips resembling comb elements.

9. The field emitter structure in claim 8, wherein the entire emitter structure is segmented into a plurality of long strips resembling comb elements.

10. The field emitter structure in claim 9, wherein the resistive element is a film between the said lead-in conductor and the emitter edge and in electrical contact with each of the emitter comb elements so as to be in series with the emitter comb elements.

11. The field emitter structure in claim 9, wherein the resistive element is film segmented into several comb elements between the said lead-in conductor and the emitter edge and in electrical contact with each of the emitter comb elements so as to be in series with the emitter comb elements.

12. The field emitter structure in claim 7, wherein the resistive element is a film between said lead-in conductor and the emitter edge and in electrical contact with the emitter so as to be in series with the emitter.

13. The field emitter structure as set forth in claim 8, further comprising at least one control electrode that is spaced approximately equidistant from edges of the emitter comb elements.

14. The field emitter structure as set forth in claim 13, comprising an array of flat emitter structures, each flat emitter structure of said array being like that of said flat emitter structure.

15. An emitter comprising:

a field emitter structure, for emitting electrons, segmented into a plurality of long strips resembling comb elements, for isolating possible burn-out problems, said emitter structure having an input;

a resistive element having a first end connected to the input of said field emitter structure, and having a second end for connection to an external electrical power source, said resistive element for providing current limiting for said field emitter structure; and a capacitive element having a first end connected to the first end of said resistive element and a second end connected to the second end of said resistive element, said capacitive element for by-passing AC current around said resistive element to the input of said field emitter structure.

16. The emitter of claim 15 wherein ends of the long strips of said field emitter structure each have a ridged edge with a rounded-like shape for elimination of concentration of electron emission.

17. The emitter of claim 16 further comprising at least one control element for controlling the passage of electrons emitted from said field emitter structure on to an anode.

* * * * *